United States Patent [19]

Iwai

[11] Patent Number: 4,810,218

[45] Date of Patent: Mar. 7, 1989

[54] MARINE PROPULSION DEVICE

[75] Inventor: Tomio Iwai, Hamamatsu, Japan

[73] Assignee: Sanshin Kogyo Kabushiki Kaisha, Hamamatus, Japan

[21] Appl. No.: 71,617

[22] Filed: Jul. 9, 1987

[30] Foreign Application Priority Data

Jul. 10, 1986 [JP] Japan ..... 61-160793

[51] Int. Cl.[4] ..... B63H 21/26

[52] U.S. Cl. ..... 440/66; 440/76

[58] Field of Search ..... 440/49, 66, 67, 76, 440/77, 78, 900

[56] References Cited

U.S. PATENT DOCUMENTS

| | | | |
|---|---|---|---|
| 1,500,073 | 7/1924 | Hass | 440/66 |
| 2,258,399 | 10/1941 | Witteman | 440/66 |
| 3,799,103 | 3/1974 | Granholm | 440/66 |
| 3,817,202 | 6/1974 | Holtermann | 440/66 |
| 4,304,557 | 12/1981 | Henrich | 440/66 |
| 4,529,387 | 7/1985 | Brandt | 440/66 |

*Primary Examiner*—Sherman D. Basinger
*Assistant Examiner*—Stephen P. Avila
*Attorney, Agent, or Firm*—Ernest A. Beutler

[57] ABSTRACT

A marine outboard drive having a lower housing configured to generate the necessary side forces to balance the side thrust of the propeller regardless of the degree of submersion of the propeller in the water.

6 Claims, 5 Drawing Sheets

MARINE PROPULSION DEVICE

BACKGROUND OF THE INVENTION

This invention relates to a marine propulsion device and more particularly to an improved propulsion device for a watercraft that will ensure against the generation of side thrust on the propulsion device regardless of the running condition.

It is well known to mount a marine propulsion device so that it can be trimmed up or trimmed down depending upon the running condition. Normally during high speed running the propulsion device is trimmed up so that the propeller is not submerged as deeply as when running at low speeds or when accelerating. As a result, when the outboard drive is operated in its trimmed up condition, the propeller is only partially submerged while when in its trimmed down condition, the propeller is substantially fully submerged. Although this arrangement provides the desired amount of propeller submersion for the various running conditions, it can cause certain other difficulties.

As is well known, the configuration of the blades of a propeller are such that they give a forward thrust to the watercraft. In addition, due to the configuration of the blades there is also generated, on each individual blade, a side thrust in addition to the forward thrust. When a propeller is fully submerged, the side thrust balance each other due to the fact that there are multiple blades and they are positioned normally diametrically opposite to each other or at least on opposite sides of a plane passing through the center line of the propeller. However, when the outboard drive is trimmed up, only one-half of the propeller is submerged and an uneven thrust is generated that tends to cause a steering force on the outboard drive.

Devices have been proposed that will tend to offset this side thrust which occurs when the outboard drive is trimmed up. Such devices generally configure the skeg or some portion of the lower unit so as to generate an opposing side thrust that will balance that of the propeller when the propeller is not fully submerged. However, these devices by their very nature induce a side thrust which is not balanced when the propeller is fully submerged and hence give rise to forces that tend to cause the outboard drive to be steered under this condition.

It is, therefore, a principal object of this invention to provide a marine propulsion device in which the side thrusts are balanced under all trim conditions of the outboard drive.

It is a further object of this invention to provide a simplified yet effective method for balancing the side thrusts of a marine outboard drive regardless of the running or trimmed condition.

It is a further object of this invention to provide a marine propulsion device wherein the side thrusts are balanced under all running conditions and which does not require the operator's control so as to achieve this balancing.

SUMMARY OF THE INVENTION

This invention is adapted to be embodied in a marine outboard drive that is adapted to be mounted on a watercraft and which includes a propulsion device that is rotatably journaled for creating a forward thrust to propel the associated watercraft through the water. The outboard drive is supported for movement relative to the watercraft between a first position wherein the propulsion device is submerged to a first, relatively shallow position and a second position wherein the propulsion device is submerged to a second, relatively deep position. The propulsion device creates a side thrust of a first degree in one of its positions and a significantly different side thrust in the other of its positions. In accordance with the invention means are provided for creating a side force opposing the first degree of side thrust of the propulsion device when the outboard drive is in its one position and a significantly different side thrust when the outboard drive is in the other of its positions for balancing the propulsion device side thrust in both positions.

DETAILED DESCRIPTION OF THE PREFERRED EMBODIMENT

Figure 1:
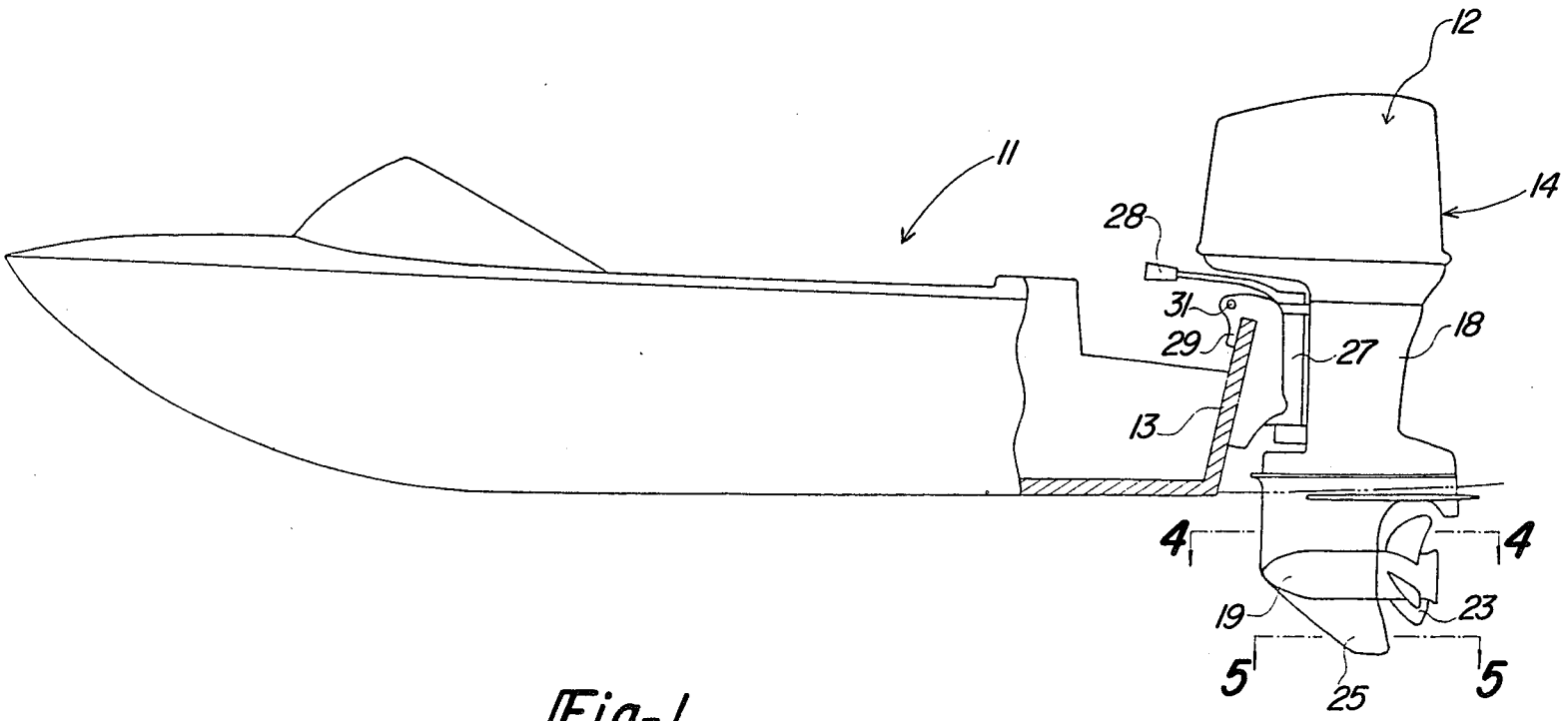
FIG. 1 is a side elevational view of a watercraft with a marine propulsion device constructed in accordance with the invention attached to the transom of a watercraft and with a portion of the watercraft broken away.
Figure 2:
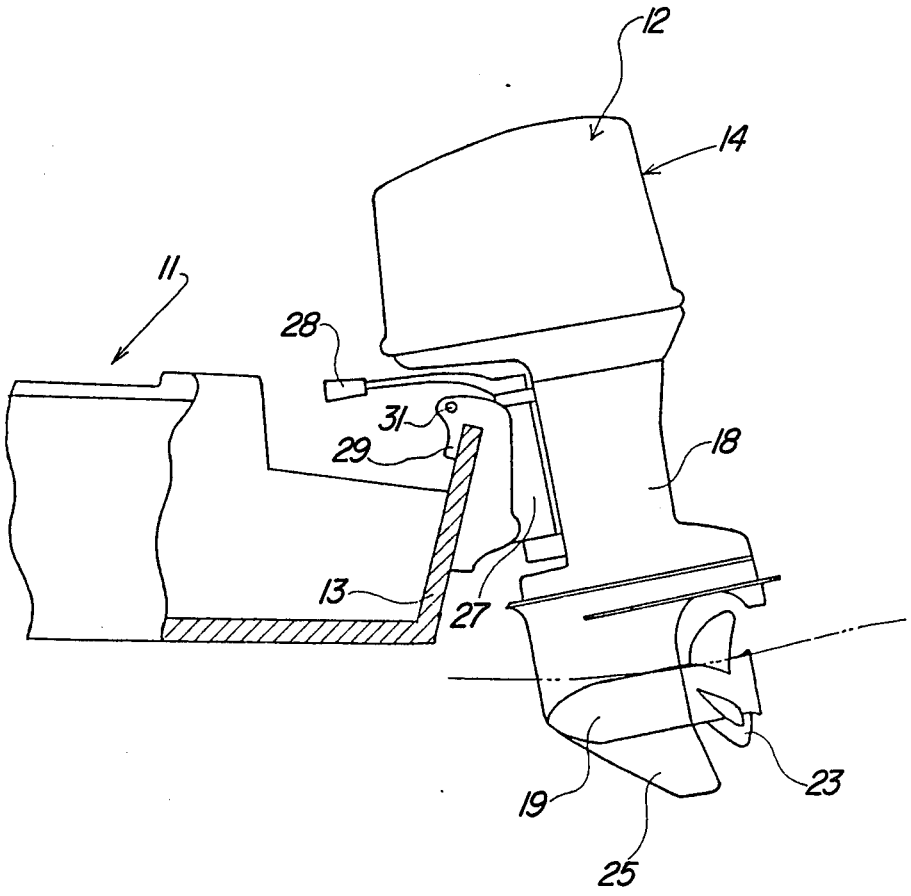
FIG. 2 is a partial side elevational view, in part similar to FIG. 1, showing the outboard drive in a tilted up condition.
Figure 3:
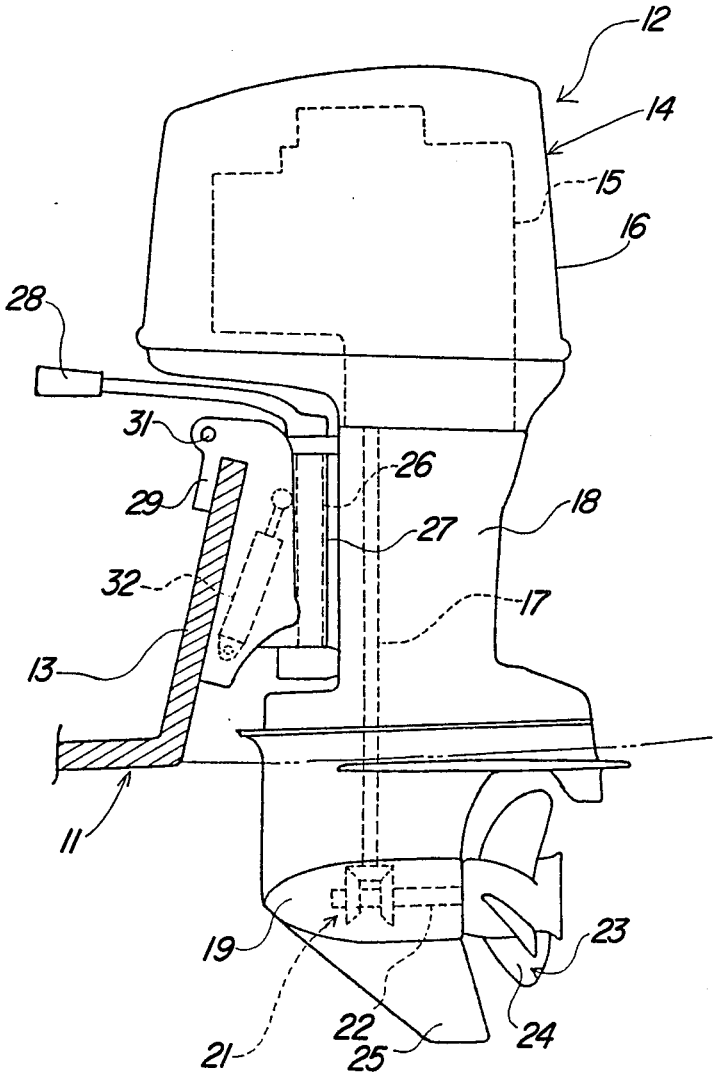
FIG. 3 is an enlarged side elevational view of the propulsion device.
Figure 4:
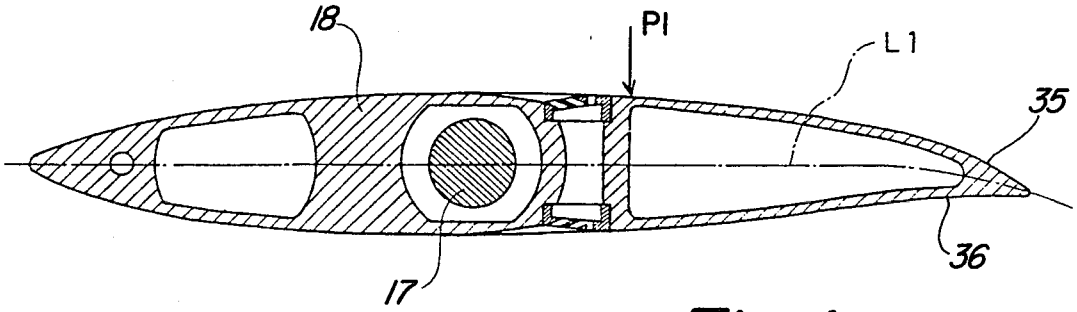
FIG. 4 is an enlarged cross sectional view taken along the line 4—4 of FIG. 1.

Referring first to FIGS. 1–3, a watercraft constructed in accordance with an embodiment of the invention is identified generally by the reference numeral 11. The watercraft has a marine outboard drive, indicated generally by the reference numeral 12, attached to the watercraft transom 13. The outboard drive 12 is, in the illustrated embodiment, an outboard motor. It is to be understood, however, that the invention may be practiced equally as well with the outboard drive portion of an inboard/outboard drive. For that reason, the term "outboard drive" is used generically to encompass both such outboard drive portions of an inboard/outboard drive or outboard motors per se.

The outboard motor 12 is comprised of a power head, indicated generally by the reference numeral 14, and including a powering internal combustion engine 15 (FIG. 3) that is surrounded by protective cowling 16 of a known type.

The engine 15 drives a drive shaft 17 (FIG. 3) that extends through and is journaled within a drive shaft housing 18 that depends from the power head 14. The drive shaft housing 18, in turn, terminates at a lower unit 19 in which a forward, neutral, reverse transmission 21 of a known type is positioned. The forward, neutral, reverse transmission 21 transfers drive from the drive shaft 17 to a propeller shaft 22 that is journaled within the lower unit 19 and which carries a propeller, indicated generally by the reference numeral 23 and having blades 24, for propelling the associated watercraft 11. The lower unit 19 further includes a skeg 25 that extends below the propeller shaft 22.

A steering shaft 26 is affixed to the drive shaft housing 18 in a known manner and is journaled within a swivel bracket 27. Pivotal movement of the steering shaft 26 relative to the swivel bracket 27 accomplishes steering of the outboard motor 12 in a known manner. A tiller 28 is affixed to the upper end of the steering shaft 26 so as to facilitate the steering of the outboard motor 12.

The swivel bracket 27 is pivotally connected to a clamping bracket 29 by means of a horizontally disposed pivot pin 31. Pivotal movement of the swivel bracket 27 and, accordingly, the outboard motor 12 relative to the clamping bracket 29 permits adjustment of the trim position of the axis of rotation of the propeller shaft 23. In addition, this pivotal movement permits the tilting up of the outboard motor 12 to an out of the water position as is well known. A hydraulic tilt and trim cylinder assembly 32 is interposed between the clamping bracket 29 and the swivel bracket 27 so as to accomplish this tilting movement. The clamping bracket 29 is affixed in any known manner to the watercraft transom 13.

It is to be understood that the construction of the outboard motor 12 as thus far described may be considered to be conventional and, for that reason, further details of the construction are not believed to be necessary to understand the construction and operation of the invention. Also, although the invention is described in conjunction with an outboard motor and tilts about a fixed pivot axis, it is to be understood that the invention may be utilized in conjunction with outboard drives that have their trim condition adjusted in other manners.

The outboard motor 12 is normally movable between a tilted down position as shown in FIG. 1, wherein the propeller 23 and all of its blades 24 are fully submerged and a tilted up high speed cruising condition as shown in FIG. 2 wherein the waterline W is such that the propeller 23 is only partially submerged and only its lowermost blades 24 are fully submerged. As a result, when the outboard motor 12 is in its tilted up condition, the propeller blades 24 will generate in addition to a forward thrust a side thrust that acts upon the blades and hence through them upon the outboard motor 12. Because the propeller blades 24 are positioned aft of the steering shaft 26 these sides thrusts will tend to cause a force on the outboard motor 12 that tends to steer it when the outboard motor 12 is tilted up to the high speed running condition shown at FIG. 2. With conventional constructions an operator must either apply a counterbalancing force to the outboard motor 12 under this condition or the outboard motor will in effect steer itself.

Figure 5:
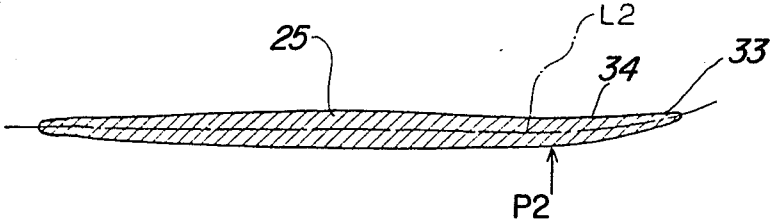
FIG. 5 is an enlarged cross sectional view taken along the line 5—5 of FIG. 1.
Figure 7:
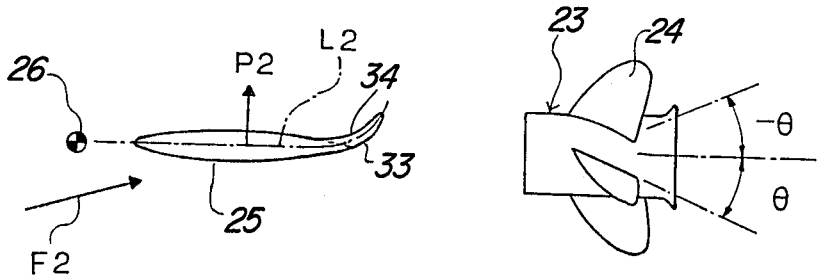
FIG. 7 is a graphical view, in part similar to FIG. 6, showing the hydrodynamic forces acting on the area shown in the cross section of FIG. 5.

In order to counterbalance the steering forces exerted under this condition the skeg 25 is provided with a trailing end section that is curved about a longitudinal center line L2 so as to form an inclined rearwardly extending section 33 that has a recessed area 34 which creates a reduced pressure area so that a side thrust will be exerted in the direction of the arrow $P_2$ as shown in FIGS. 5 and 7 during normal forward running. The side thrust $P_2$ is chosen so as to be substantially equal to the opposing side thrust generated by the submerged propeller blades 24 so as to ensure that no steering force is generated under this running condition.

Although the configuration of the skeg 25 with its curved section 33 generates the necessary side thrust to avoid steering when the outboard motor is in its tilted up condition as shown in FIG. 2, when the outboard motor is tilted down to its fully submerged position as shown in FIG. 1, the skeg side force $P_2$ will still be operative. However, under this condition the propeller blades 24 will all be fully submerged and hence the propeller itself generates no side thrust or steering force. As a result, the force $P_2$ acting on the skeg 25 will, itself, tend to cause steering of the outboard motor 12.

In order to avoid this condition, the lower unit 19 or the lower portion of the drive shaft housing 18 is formed with a curved rearward portion 35 about the center line L1 so as to create a recessed area 36 that generates a side thrust P1. The side thrust P1 is chosen so as to be equal to and in opposite direction to the skeg force P2 so that when the outboard motor 12 is fully submerged these side thrusts will balance each other and the outboard motor will operate in a fully straight ahead position with no steering side thrust.

FIG. 7 is a vector diagram showing the forces acting on the lower unit regardless of whether it is fully or partially submerged. It will be seen that the water forces F2 acting on the skeg 25 tend to cause a side thrust P2 due to the curved section 33, as aforenoted. Under this condition, if the outboard motor 12 is in the position shown in FIG. 2 the propeller 23 will only be partially submerged and only the lowermost blades will be under water. As a result, these blades will cause a side force to be generated about the pitch angle $-\ominus$ that is equal to the force P2 so that there will be no steering of the outboard motor. If, however, the outboard motor 12 is fully submerged in the FIG. 1 position, the propeller 23 will create no counterbalancing side thrust because the upper pitch angle $\ominus$ then becomes effective.

Figure 6:
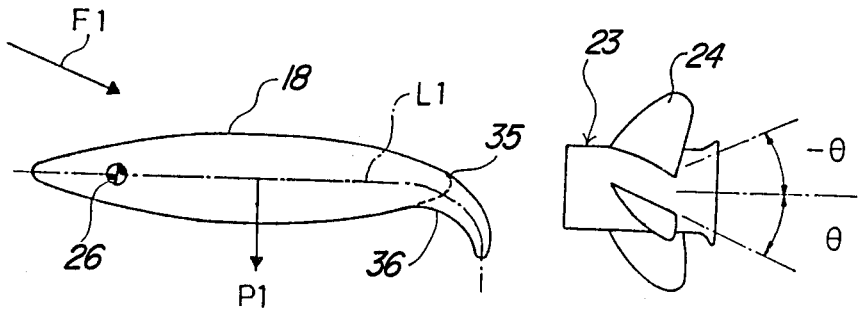
FIG. 6 is a graphical view showing the hydrodynamic forces acting on the area shown in the cross section of FIG. 4.

Under this latter condition, however, the condition shown in FIG. 6 will also be existent since the curved portion 35 of the lower unit will also be submerged and the hydrodynamic forces Fl will create a side thrust P1 that balances the side thrust P2 and ensures that no steering forces will be generated on the outboard motor 12.

It should be readily apparent from this description that the arrangement is such that the outboard motor lower unit and drive shaft housing are configured so that the side thrust will always be balanced under the various trim conditions of the outboard motor and no steering forces will be generated regardless of whether the propeller 23 is fully or partially submerged. Also, no control by the operator is necessary to achieve this balancing in operation.

Although the invention has been described in conjunction with the formation of the curved surfaces of the skeg and lower unit being integral with them, it should be readily apparent that this arrangement may be achieved through the use of separate tab members which are affixed to the various portions of the outboard drive. Various other changes and modifications may be made without departing from the spirit and scope of the invention, as defined by the appended claims.

I claim:

1. In a marine outboard drive adapted to be mounted on a watercraft, a propulsion device rotatably journaled by said outboard drive for creating a forward thrust to propel the associated watercraft through the water, said outboard drive being supported for movement relative to the watercraft between a first position wherein said propulsion device is submerged to a first relatively shallow position and a second position wherein said propulsion device is submerged to a second relatively deep position, said propulsion device creating a side thrust of a first degree when in one of said positions and a significantly different side thrust when in the other of said positions, and means for creating a side force opposing said first degree of side thrust when said outboard drive is in said one position and a significantly different side force when said outboard drive is in the other of said positions for balancing said propulsion device side thrusts regardless of the position of the outboard drive.

2. A marine outboard drive defined in claim wherein the propulsion device comprises a propeller having at least two blades, one of said blades being submerged when said outboard drive is in its first position and all of said blades being submerged when said outboard drive is in its second position.

3. A marine outboard drive defined in claim 1 wherein the means for developing the side forces comprise a pair of oppositely curved portions formed on the outboard drive.

4. A marine outboard drive defined in claim wherein the oppositely curved portions are formed respectively above and below the axis of rotation of the propulsion device.

5. A marine outboard drive defined in claim 4 wherein the propulsion device comprises a propeller having at least two blades, one of said blades being submerged when said outboard drive is in its first position and all of said blades being submerged when said outboard drive is in its second position.

6. A marine outboard drive defined in claim 5 wherein the outboard drive is supported for pivotal movement between its positions.

* * * * *

UNITED STATES PATENT AND TRADEMARK OFFICE

CERTIFICATE OF CORRECTION

PATENT NO. : 4,810,218

DATED : March 7, 1989

INVENTOR(S) : Tomio Iwai

It is certified that error appears in the above-identified patent and that said Letters Patent is hereby corrected as shown below:

Column 2, line 43, after "watercraft" insert —11—.

Column 5, line 16, Claim 2, after "claim" insert —1—.

Column 6, line 7, Claim 4, after "claim" insert —1—.

Signed and Sealed this

Twenty-third Day of July, 1991

*Attest:*

*Attesting Officer*

HARRY F. MANBECK, JR.

*Commissioner of Patents and Trademarks*